US006498130B2

(12) United States Patent
Baum et al.

(10) Patent No.: US 6,498,130 B2
(45) Date of Patent: Dec. 24, 2002

(54) LUBRICATING GREASE COMPOSITION AND PREPARATION

(75) Inventors: Mark William Baum, Kansas City, MO (US); Todd Timothy Nadasdi, Mount Laurel, NJ (US); Jon Carl Root, Leawood, KS (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 0 days.

(21) Appl. No.: 09/895,907

(22) Filed: Jun. 29, 2001

(65) Prior Publication Data

US 2002/0039973 A1 Apr. 4, 2002

Related U.S. Application Data

(60) Provisional application No. 60/217,302, filed on Jul. 11, 2000.

(51) Int. Cl.[7] ..... C10M 169/02
(52) U.S. Cl. ..... 508/552
(58) Field of Search ..... 508/552

(56) References Cited

U.S. PATENT DOCUMENTS

| | | | | | |
|---|---|---|---|---|---|
| 3,488,721 | A | * | 1/1970 | Frye | 508/552 |
| 3,671,429 | A | * | 6/1972 | Wright | 508/552 |
| 3,753,906 | A | * | 8/1973 | Burton | 508/552 |
| 3,791,973 | A | * | 2/1974 | Gilani et al. | 508/552 |
| 4,297,227 | A | * | 10/1981 | Witte | 508/552 |
| 4,392,967 | A | | 7/1983 | Alexander | 252/41 |
| 4,444,669 | A | * | 4/1984 | Wittse, Jr. et al. | 508/552 |
| 4,759,859 | A | * | 7/1988 | Waynick | 508/552 |
| 5,084,193 | A | * | 1/1992 | Waynick | 508/552 |
| 5,314,982 | A | | 5/1994 | Rasp et al. | 528/48 |
| 5,350,531 | A | * | 9/1994 | Musilli | 508/552 |
| 5,387,351 | A | * | 2/1995 | Kumar et al. | 508/552 |

FOREIGN PATENT DOCUMENTS

| | | | |
|---|---|---|---|
| GB | 776548 | | 6/1957 |
| GB | 0776548 | * | 6/1957 |
| WO | WO 99/42541 | * | 8/1999 |

* cited by examiner

*Primary Examiner*—Jacqueline V. Howard
(74) *Attorney, Agent, or Firm*—Paul E. Purwin

(57) ABSTRACT

A grease composition having low noise characteristics is prepared by shearing a mixture of a base oil and a thickener for a time sufficient to reduce substantially all of the thickener to particles below 500 microns in size; and then processing the sheared mixture to a grease.

9 Claims, No Drawings

LUBRICATING GREASE COMPOSITION AND PREPARATION

This application claims the benefit of U.S. Provisional Application No. 60/217,302 Jul. 11, 2000.

The present invention relates to lubricating grease compositions and the preparation thereof and more especially with lubricating greases having low noise characteristics.

BACKGROUND OF INVENTION

Industrial lubricating greases are homogeneous products of a semi-liquid to solid consistency. Essentially they consist of a dispersion of a thickener in a liquid lubricant or base oil. In general the thickener is a significant determinant of the properties of the greases.

Typical thickeners used in forming greases include metal soaps, such as lithium salts of fatty acids, non-soaps such as organophilic clay minerals and polyurea compounds.

To improve the performance properties of a grease additional materials may be incorporated in the base grease, such as extreme pressure additives, antioxidants, rust-inhibitors, viscosity index improvers and mixtures thereof.

In preparing grease compositions a thickener and the other additives often are added to the base oil and the resulting mixture is heated and stirred and then passed through a roll mill or the like to obtain the grease. In the case of polyurea thickened greases the polyurea generally is prepared in situ by the reaction of amines with isocyanates in a base oil, followed by mixing with the other additives and milling to provide a homogeneous end grease composition.

User demand for low noise greases in bearing applications has been increasing steadily; however, manufacturing greases with low noise characteristics has proven time consuming and expensive compared to more conventional greases.

Accordingly an object of the present invention is to provide an improved process for making a grease with low noise characteristics which is less time consuming.

Another object of the present invention is to provide a process for making a grease which can be practiced on an industrial scale.

These and other objects of the invention will become apparent upon from the following description of the invention.

SUMMARY OF INVENTION

Simply stated, a grease composition having low noise characteristics is prepared by:

shearing a mixture of a base oil and thickener for a time sufficient to reduce substantially all of thickener particles sizes below 500 microns; and processing the sheared mixture to a grease.

DETAILED DESCRIPTION OF THE INVENTION

The invention will be explained in more detail hereinafter.

A wide variety of lubricating base oils can be employed in the process and grease compositions of the present invention. Thus, the lubricating oil base can be any of the conventionally used mineral oils, synthetic hydrocarbon oils or synthetic ester oils, or mixtures thereof depending upon the particular grease being prepared. In general these lubricating oils will have a viscosity in the range of about 5 to about 400 cSt at 40° C., although typical applications will require an oil having a viscosity ranging from about 10 to about 200 cSt at 40° C. Mineral lubricating oil base stocks used in preparing the greases can be any conventionally refined base stocks derived from paraffinic, naphthenic and mixed base crudes. Synthetic lubricating oils that can be used include esters of glycols such as a $C_{13}$ oxo acid diester of tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as polyalphaolefins; alkyl benzenes, e.g., alkylate bottoms from the alkylation of benzene with tetrapropylene, or the copolymers of ethylene and propylene; silicone oils, e.g., ethyl phenyl polysiloxanes, methyl polysiloxanes, etc., polyglycol oils, e.g., those obtained by condensing butyl alcohol with propylene oxide; carbonate esters, e.g., the product of reacting $C_8$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups.

Also, a wide variety of thickeners may be employed in preparing the greases of the present mixture. For example, a soap thickener such as a metal soap and a complex metal soap; a non-soap thickener such as bentone, silica gel, urea compounds, urea-urethane compounds and urethane compounds may be employed.

For lithium complex soap greases, preferred thickeners contain two, more preferably, three lithium components. The first may be a lithium soap of at least one, hydroxy fatty acid, preferably $C_{12}$ to $C_{29}$. The second may be selected from a lithium compound of (i) a $C_2$ to $C_{12}$ aliphatic or cycloaliphatic dicarboxylic acid (or $C_1$ to $C_{10}$, such as $C_1$ to $C_4$, alkyl ester thereof); or (ii) of a $C_3$ to $C_{24}$ hydroxy carboxylic acid (or $C_1$ to $C_{10}$, such as $C_1$ to $C_4$, alkyl ester thereof) which has the hydroxy group separated from the carboxyl group by six or less carbon atoms; or a mixture thereof. The third component, which is very preferably present, is a lithium salt of boric acid.

Preferred hydroxy fatty acids include hydroxystearic, hydroxy-ricinoleic, hydroxybehenic and hydroxypalmitic. Especially preferred is 12-hydroxystearic acid. The second lithium compound is preferably a $C_3$ to $C_{10}$ aliphatic dicarboxylic acid, more preferably azelaic or sebacic acids, especially azelaic acid, or said ester of any of these. The $C_3$ To $C_{24}$ hydroxycarboxylic acid is preferably lactic acid, salicylic acid or other hydroxy-benzoic acid, more preferably salicylic acid or a said ester of any of these. The amount of lithium soap complex thickeners is very preferably from 5 to 20 wt %, based on grease. The weight ratio of hydroxy fatty acid to aliphatic dicarboxylic acid and/or hydroxycarboxylic acid is preferably from 10:0.5 to 10:15, very preferably 10:1.5 to 10:6. The weight ratio of boric acid to the dicarboxylic and/or hydroxy carboxylic acid will preferably be from 1:5 to 1:20 very preferably 1:10 to 1:15.

Examples of urea compounds, the urea-urethane compounds and the urethane compounds include diurea compounds, triurea compounds, tetraurea compounds, polyurea compounds other than the aforementioned urea compounds, urea-urethane compounds, diurethane compounds and mixtures thereof.

In the practice of the present invention polyurea compounds are especially preferred thickeners. Typically the polyurea compounds are the reaction products of primary amines and diisocyanates.

The mono amine include aliphatic, alicyclic and aromatic amines and mixtures thereof. Examples of such monoamines include pentylamine, hexyl-amine, heptylamine, octylamine, dodecylamine, cyclohexylamine, benzylamine, aniline, laurylamine, palmitylamine and the like.

The diisocyante component preferably is selected from an aromatic diisocyantes or mixtures of aromatic diisocyanates. Examples of such diisocyantes are phenylene diisocyante, toluene diisocyantes, xylene diisocyante, methylene diphenylene diisocyante and the like.

Typically the amines and diisocyantes are reacted in equal equivalents to form the polyurea thickener.

In preparing the grease compositions of the invention a major amount of the base oil and from about 2 to about 25 wt % thickener, based on the total weight of the composition are combined in a vessel, such as a grease making kettle, and are agitated with heating from about 25° C. to 100° C. and preferably in the range of about 25° C. to 50° C. when the thickener is a urea type, e.g., a polyurea and when the thickener is a lithium thickener, from about 80° C. to about 100° C.

In the case of a polyurea thickened grease, the polyurea compound preferably is formed by heating the reactants, i.e., the amine and diisocyante in the base oil to temperature and for a time sufficient to form the polyurea thickener. Typical temperatures are in the range of about 25° C. to about 60° C. Thereafter the so formed polyurea and oil are mixed as above.

A key step in the process of this invention is shearing the mixture of the base oil and thickener for a time sufficient to reduce substantially all of the thickener particles to below 500 microns in size. Preferably the mixture is sheared so that all of the particles are less than 200 microns in size and 95% of the particles are below 100 microns in size. Most preferably shearing is done to reduce substantially all the particles below 100 microns in size with 95% below 50 microns in size.

Any suitable shearing device may be employed such as static mixers, mechanical systems having counter rotating paddles, cone and stator mills, roll mills and the like.

Shearing of the oil and thickener may be conducted at whatever temperature the mixture has been heated to; however, it is preferred to shear the mixture at temperature below about 65° C., for example between about 35° C. to about 55° C.

It will be appreciated that to obtain the requisite thickener particle size in the base oil more than one pass of the mixture through the shearing device may be required. In such an instance the mixture of thickener and base oil may be passed repeatedly from the kettle though the shearing device and returned to the mixing kettle for the necessary time to achieve the requisite particle size. Alternatively, of course, the mixture may be passed through a series of shearing devices and kettles.

After shearing the thickener and base oil, the resultant sheared product is processed to a grease. Typically processing to a grease includes cooking the mixture in the range 150° C. to 175° C. and milling to form a homogeneous grease. Milling may be conducted at temperatures in the range of about 10° C. to about 175° C. However, it is preferred to cool the mixture to about 25° C. to about 105° C. for milling.

Any suitable milling device may be employed such as homogenizing milling devices known in the art.

Optional grease additives such as extreme pressure additives, antioxidants, rust inhibitors, antiwear compounds and the like may be added to the sheared mixture before milling.

Other standard grease manufacturing procedures such as filtering and de-airating the grease may be employed.

EXAMPLES

Example 1

Two chemically identical mixtures of a base oil and a polyurea thickener were prepared in a kettle and each was subjected to shearing by stirring the mixture in the kettle with counter rotating paddles and passing the mixture through a static mixer and core and stator mill at the temperature and for the time periods shown in Table 1.

TABLE 1

Batch Temperature vs. Milling Time

| | Batch Temperature (° C.) | |
|---|---|---|
| Milling Time (hours) | Sample A | Sample B |
| 0 | 51.7 | 37.8 |
| 1 | 56.1 | 46.7 |
| 2 | 57.8 | 46.7 |
| 3 | 58.3 | 47.8 |
| 4 | 58.3 | 49.4 |

The particle size of the thickener in each mixture was determined by observation of a 10 mg sample under a microscope at 100× magnification. The samples were taken at the time intervals shown in Table 2. The resultant particle size also is given.

TABLE 2

Thickener Particle Size Reduction vs. Milling Time

| | No. of particles 0.05 < 0.10 mm | | No. of particles 0.10 < 0.15 mm | | No. of particles 0.15 < 0.20 mm | |
|---|---|---|---|---|---|---|
| Time (hours) | Sample A | Sample B | Sample A | Sample B | Sample A | Sample B |
| 0 | 75 < 100 | ~25 | ~20 | 3 | 5 | 0 |
| 1 | 50 < 75 | 1 | 5 | 0 | 0 | 0 |
| 2 | 25 < 50 | 0 | 3 | 0 | 0 | 0 |
| 3 | 3 | 0 | 1 | 1 | 0 | 0 |
| 4 | 2 | 0 | 0 | 0 | 0 | 0 |

Notes:
(1) Time zero is just prior to initiation of milling through the Mill.
(2) Samples were collected from intake side of mill, therefore representative of bulk of batch.

As can be seen maintaining the temperature during milling below about 55° C. provides a more efficient particle reduction step.

Example 2

Following the method of Example 1 a mixture of a polyurea thickener and base oil were prepared and sheared. After shearing the grease was cooked to a top temperature of about 160° C. After cooling to about 93° C., an antioxidant, rust inhibitor, and more base oil were added. One portion, Batch C, was finished by passing the grease through a shear valve at 100 psi. The other portion, Batch D, was treated as Batch C and then passed through a homogenation mill at 2000 psi. The noise characteristics of each were determined using an SKF Be-Quiet noise tester. The data is given in Table 3.

TABLE 3

| | Batch C | Batch D |
|---|---|---|
| Noise Average ($\mu$m/second) | 19.1 | 11.2 |

What is claimed is:

1. A process for preparing a grease having low noise characteristics comprising:

shearing a mixture of a base oil and a thickener for a time sufficient to reduce substantially all of the thickener particles to below 500 microns in size;

heating the mixture in the range of about 150° C. to about 175° C.; and milling the heated mixture to form a homogeneous grease.

2. The process of claim 1 wherein during shearing the mixture is maintained at a temperature below about 65° C.

3. The process of claim 2 wherein the mixture of base oil and thickener is formed by combining base oil and thickener in a vessel and agitating the combination with heating in the range of about 25° C. to 100° C.

4. The process of claim 3 including forming a polyurea thickener in a base oil and agitating the thickener and base oil at a temperature in the range of about 25° C. to 60° C. to form a mixture of base oil and thickener.

5. The process of claim 4 wherein the mixture is sheared for a time sufficient to reduce the thickener particles to less than 200 microns in size with about 95% of the particles below 100 microns in size.

6. The process of claim 4 wherein the melting is conducted at a temperature in the range of about 25° C. to about 105° C.

7. A process for preparing a grease comprising:

agitating a thickener and a base oil in a vessel to form a mixture;

cycling the mixture through a shearing device for a time sufficient to reduce the particle size of the thickener in the base oil to below 500 microns;

heating the sheared mixture in the range of about 150° C. to about 175° C.; and milling the heated mixture to form a homogeneous grease.

8. The process of claim 7 wherein during shearing the mixture is maintained at a temperature below about 65° C.

9. The process of claim 8 wherein melting is conducted at about 25° C. to about 105° C.

* * * * *